US010950181B2

(12) United States Patent
Han et al.

(10) Patent No.: US 10,950,181 B2
(45) Date of Patent: Mar. 16, 2021

(54) DISPLAY DEVICE FOR IMPROVING A DISPLAY DELAY AND A METHOD OF DRIVING THE DISPLAY DEVICE

(71) Applicant: SAMSUNG DISPLAY CO., LTD., Yongin-si (KR)

(72) Inventors: Sang Myeon Han, Hwaseong-si (KR); Seung Ho Park, Suwon-si (KR); Jae Hoon Lee, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/453,192

(22) Filed: Jun. 26, 2019

(65) Prior Publication Data

US 2020/0058255 A1 Feb. 20, 2020

(30) Foreign Application Priority Data

Aug. 20, 2018 (KR) ..... 10-2018-0096649

(51) Int. Cl.
*G09G 3/20* (2006.01)
*G09G 3/3275* (2016.01)

(52) U.S. Cl.
CPC ..... *G09G 3/3275* (2013.01); *G09G 3/2003* (2013.01)

(58) Field of Classification Search
None
See application file for complete search history.

(56) References Cited

U.S. PATENT DOCUMENTS

2008/0068293 A1* 3/2008 Ishii ..... G09G 3/3611 345/3.1
2015/0062137 A1* 3/2015 Yu ..... G09G 3/3233 345/531
2017/0213493 A1 7/2017 Han

FOREIGN PATENT DOCUMENTS

KR 10-2015-0025987 3/2015
KR 10-2015-0078357 7/2015
KR 10-2015-0078753 7/2015

* cited by examiner

*Primary Examiner* — Amr A Awad
*Assistant Examiner* — Donna V Lui
(74) *Attorney, Agent, or Firm* — F. Chau & Associates, LLC

(57) ABSTRACT

Systems and methods are described for displaying an image during an initial driving period. An exemplary display device includes a timing controller configured to reconstruct compensation reference data from a first memory into a plurality of transmission data, sequentially transmit the plurality of transmission data to a second memory, and display an image on the display panel when partial transmission data of the plurality of transmission data are transmitted and stored to the second memory during the initial driving period.

16 Claims, 12 Drawing Sheets

<APPLYING PERIOD OF COMPENSATION REFERENCE DATA>

DISPLAY DEVICE FOR IMPROVING A DISPLAY DELAY AND A METHOD OF DRIVING THE DISPLAY DEVICE

This application claims priority from and the benefit of Korean Patent Application No. 10-2018-0096649 filed on Aug. 20, 2018, which is hereby incorporated by reference for all purposes as if fully set forth herein.

BACKGROUND OF THE INVENTION

1. Field of the Invention

Exemplary embodiments of the inventive concept relate to a display device and a method of driving the display device. More particularly, exemplary embodiments of the inventive concept relate to a display device for improving a display delay during an initial driving period and a method of driving the display device.

2. Description of the Related Art

A display device may include a liquid crystal display (LCD) device and an organic light emitting display (OLED) device.

As technology improves, display devices are becoming larger and higher resolution. As a display device becomes larger and higher resolution, it becomes more difficult to obtain high display quality due. For example, it may be more difficult to ensure to the uniformity of the position of the optical characteristics and the light change characteristics.

Accordingly, various image quality compensation driving techniques are used to enhance the display quality of display devices. However, in some cases, image quality compensation driving techniques rely on compensation reference data to compensate image data.

In general, the amount of compensation reference data may increase depending on the resolution and compensation accuracy. In some cases, the compensation reference data are stored in a nonvolatile memory. However, due to limitations on the communication bandwidth and the number of writes for controlling the non-volatile memory, the compensation reference data may also be stored in a volatile memory, such as a random access memory (RAM), at the initial driving period and used as reference data in compensation driving.

In the initial driving period of the display device, an image is displayed on a display device after a delay. For example, the display device may wait until a large amount of compensation reference data is transmitted before displaying the image. Such a delay may cause inconvenience to the user.

BRIEF SUMMARY OF THE INVENTION

Exemplary embodiments of the inventive concept provide a display device for improving a display delay during an initial driving period.

Exemplary embodiments of the inventive concept provide a method of driving the display device.

According to an exemplary embodiment of the inventive concept, there is provided a display device including a display panel comprising a plurality of pixels, a first memory configured to store compensation reference data, a second memory, a data compensating part configured to compensate image data using the compensation reference data stored in the second memory, and a timing controller configured to reconstruct the compensation reference data into a plurality of transmission data, sequentially transmit the plurality of transmission data to the second memory, and display an image on the display panel when partial data of the plurality of transmission data are transmitted and stored to the second memory during an initial driving period.

In an exemplary embodiment, tire compensation reference data may include m ('m' is a natural number) compensation reference data corresponding to m compensating blocks, the display panel divided into the m compensating blocks, each of the m compensating blocks including at least one pixel unit, and the pixel unit including a plurality of color pixels.

In an exemplary embodiment, the timing controller may be configured to divide compensation reference data into k ('k' is a natural number) partial reference data, and reconstruct the k partial reference data of the m compensation reference data into k transmission data.

In an exemplary embodiment, the timing controller may be configured divide the compensation reference data into partial reference data by a color.

In an exemplary embodiment, first partial reference data of the k partial reference data are most significant bit (MSB) data.

In an exemplary embodiment, the timing controller may be configured to display the image on the display panel when first transmission data of the k transmission data are transmitted and stored to the second memory.

In an exemplary embodiment, the timing controller may be configured to store transmission data transmitted from the first memory in a first position in the second memory and store default data in a second position in the second memory corresponding to transmission data not transmitted from the first memory.

In an exemplary embodiment, the data compensating part may be configured to compensate image data using compensation reference data updated in the second memory whenever each transmission data are transmitted and stored to the second memory.

In an exemplary embodiment, the data compensating pan may be configured to compensate image data using compensation reference data updated in the second memory whenever each partial reference data in transmission data are transmitted and stored to the second memory.

In an exemplary embodiment, the data compensating part may be configured to compensate image data using compensation reference data updated in tire second memory whenever at least one transmission data are transmitted and stored to the second memory and at least one partial reference data in transmission data are transmitted and stored to the second memory.

According to an exemplary embodiment of the inventive concept, there is provided a method of driving a display device which includes a display panel including a plurality of pixel units. The method includes reconstructing compensation reference data stored in a first memory into a plurality of transmission data during an initial driving period, sequentially transmitting the plurality of transmission data to second memory in order, and displaying an image on the display panel when partial data of the plurality of transmission data are transmitted and stored to the second memory.

In an exemplary embodiment, the compensation reference data comprise m ('m' is a natural number) compensation reference data corresponding to m compensating blocks, the display panel divided into the m compensating blocks, each of the m compensating blocks including at least one pixel unit, and the pixel unit including a plurality of color pixels.

In an exemplary embodiment, the method may further include dividing compensation reference data into k ('k' is a natural number) partial reference data, and reconstructing k partial reference data of the m compensation reference data into k transmission data.

In an exemplary embodiment, the method may further include dividing the compensation reference data into partial reference data by a color.

In an exemplary embodiment, first partial reference data of the k partial reference data may be most significant bit (MSB) data.

In an exemplary embodiment, the method may further include displaying the image on the display panel when first transmission data of the k transmission data are transmitted and stored to the second memory.

In an exemplary embodiment, the method may further include storing transmission data transmitted from the first memory in a position in the second memory, and storing default data in a position in the second memory corresponding to transmission data not transmitted from the first memory.

In an exemplary embodiment, the method may further include compensating image data using compensation reference data updated in the second memory whenever each transmission data are transmitted and stored to the second memory.

In an exemplary embodiment, the method may further include compensating image data using compensation reference data updated in the second memory whenever each partial reference data in transmission data are transmitted and stored to the second memory.

In an exemplary embodiment, the method may further include compensating image data using compensation reference data updated in the second memory whenever each transmission data are transmitted and stored to the second memory, and compensating image data using compensation reference data updated in the second memory whenever each partial reference data in transmission data are transmitted and stored to the second memory.

According to the inventive concept, during an initial driving period of the display device, such as a booting time or an initialization time, the compensation reference data stored in the first memory are reconstructed the plurality of transmission data and the plurality of transmission data is sequentially transmitted to the second memory in order. The display panel may display an image before the entire compensation data are transmitted to the second memory and thus, at the initial driving period of the display device, the display delay of the image may be improved.

BRIEF DESCRIPTION OF THE DRAWINGS

The above and other features and advantages of the inventive concept will become more apparent by describing exemplary embodiments in detail, with reference to the accompanying drawings.

DETAILED DESCRIPTION OF THE INVENTION

Hereinafter, the inventive concept will be explained in detail with reference to the accompanying drawings. Certain embodiments disclosed herein relate to storing and retrieving compensation reference data during an initial driving period of a display device (e.g., a booting time or an initialization time). During the initial driving period, compensation reference data stored in a first memory may be reconstructed along with the transmission data, and transmission data may then be transmitted to a second memory. The disclosed methods and apparatus may enable a display panel to display an image before all of the entire compensation data is transmitted to the second memory, which may reduce a delay before the display panel is able to display an image.

Figure 1:
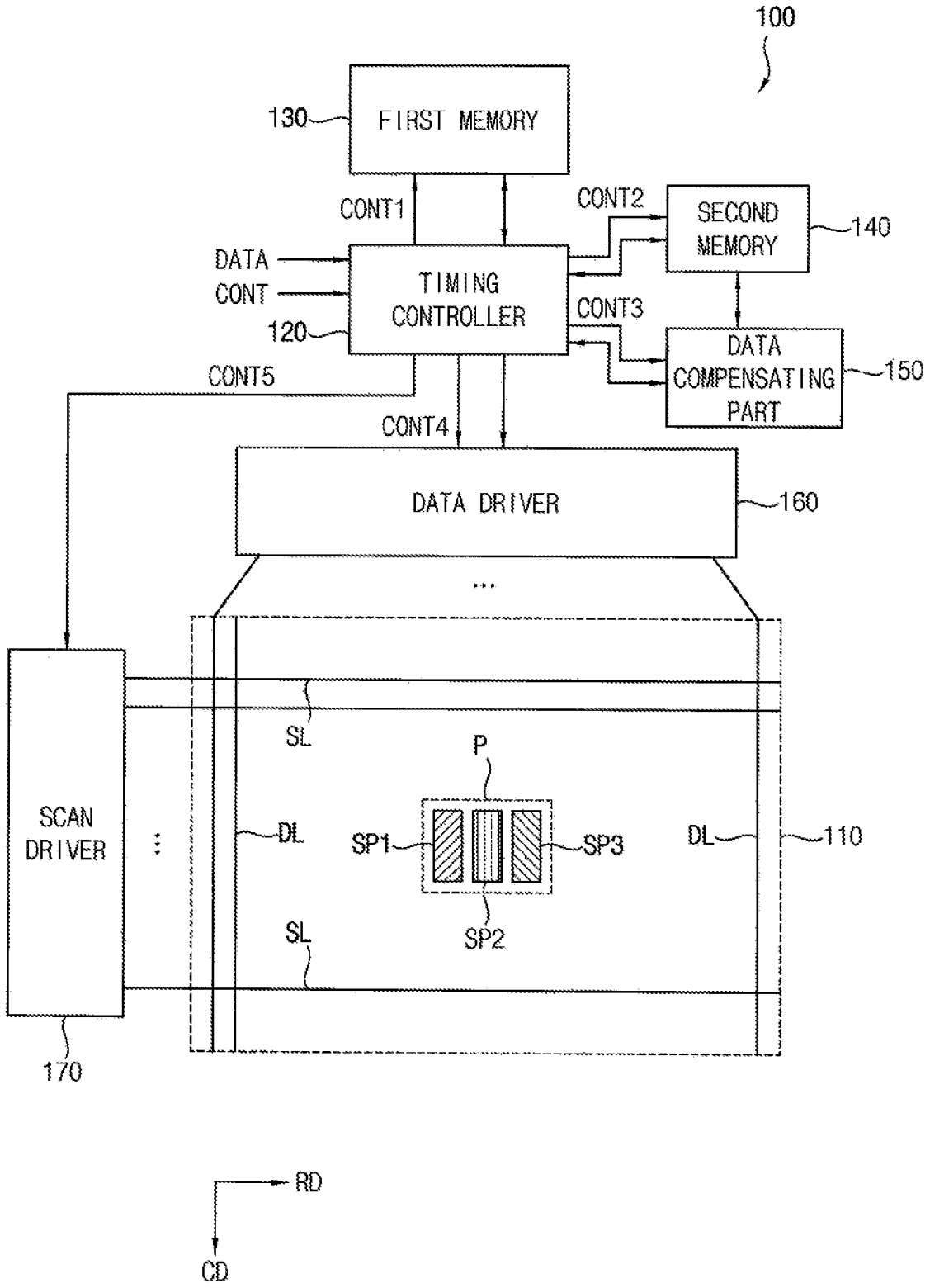
FIG. 1 is a block diagram illustrating a display device according to embodiments of the present disclosure.

FIG. 1 is a block diagram illustrating a display device according to embodiments of the present disclosure.

Referring to FIG. 1, the display device 100 may include a display panel 110, a timing controller 120, a first memory 130, a second memory 140, a data compensating part 150, a data driver 160 and a scan driver 170.

The display panel 110 may include a plurality of pixel units P, a plurality of data lines DL and a plurality of scan lines SL. The display panel may include a liquid crystal display (LCD) panel, an organic light emitting display (OLED) panel and a light emitting diode (LED) panel.

The plurality of pixel units P is arranged as a matrix type which includes a plurality of pixel rows and a plurality of pixel columns.

Each of the pixel units P may include a plurality of color pixels. The color pixels may include a first color pixel SP1 displaying a first color, a second color pixel SP2 displaying a second color and a third color pixel SP3 displaying a third color.

For example, the pixel unit P may include red, green and blue pixels. Alternatively, the pixel unit P may include red, green, blue and white pixels.

The plurality of data lines DL extends in a column direction CD and is arranged in a row direction RD crossing the column direction CD (i.e., column direction CD is substantially perpendicular to row direction RD).

The plurality of scan lines SL extends in the row direction CD and is arranged in the column direction RD.

The timing controller 120 may be configured to generally control driving of the display device. The timing controller 120 may be configured to receive image data DATA and a control signal CONT from an external graphics device.

The timing controller 120 may be configured to generate a plurality of control signals based on the control signal CONT. The plurality of control signals may include a first control signal CONT1 to control reading and writing of the first memory 130, a second control signal CONT2 to control reading and writing of the second memory 140, a third control signal CONT3 to control the data compensating part 150, a fourth control signal CONT4 to control the data driver 160, and a fifth control signal CONT5 to control the scan driver 170.

The first memory 130 may be configured to store compensation reference data (or compensating an image quality. The compensation reference data are reference data for compensating a display quality (e.g., to improve uniformity of optical characteristics and light variation characteristics of the display panel 110). The first memory 130 may include a non-volatile memory, a flash memory and an EEPROM, and the like.

The second memory 140 may be configured to store the compensation reference data transmitted from the first memory 130 while the display device operates. The compensation reference data stored in the second memory 140 are used as the reference data to compensate image data when the data compensating part 150 is driven. The second memory 140 may volatile memory, such as RAM.

The timing controller 120 may be configured to transmit and store the compensation reference data stored in the first memory 130 to the second memory 140 during an initial driving period of the display device 100, such as a booting time or an initialization time. The timing controller 120 may be configured to reconstruct the compensation reference data stored in the first memory 130 into a plurality of transmission data, and sequentially transmit the plurality of transmission data in order.

The data compensating part 150 may be configured to generate compensation image data by compensating the image data using the compensation reference data stored in the second memory 140 (i.e., the reconstructed compensation reference data or the plurality of transmission data) according to the control of the timing controller 120.

The data driver 160 may be configured to generate a data voltage corresponding to the image data DATA according to the control of the timing controller 120 and provide the data voltage to the plurality of data lines DL.

The scan driver 170 may be configured to generate a scan signal according to the control of the timing controller 120 and sequentially provide the scan signals to the plurality of scan lines SL.

For example, the timing controller 120 may control the data driver 160 and the scan driver 170 to display an image on the display panel 110 when at least partial data of the plurality of transmission data are transmitted to the second memory 140.

For example, the timing controller 120 may control the data driver 160 and the scan driver 170 to display an image on the display panel 110 when first transmission data of the plurality of transmission data are transmitted to the second memory 140.

In addition, the timing controller 120 may control when the compensation reference data stored in the second memory 140 (i.e., the reconstructed compensation reference data or the plurality of transmission data) are applied to the data compensating part 150, e.g., according to a transmission order of the plurality of transmission data.

For example, the timing controller 120 may drive the data compensating part 150 using the compensation reference data stored in the second memory 140 whenever each of the plurality of transmission data are transmitted and stored to the second memory 140.

The data compensating part 150 may be configured to generate the compensation image data by referring to the compensation reference data stored in the second memory 140, i.e., after the first transmission data of the plurality of transmission data are transmitted and stored to the second memory 140. Subsequently, the data compensating part 150 may be configured to generate additional compensation image data by referring to the compensation reference data in the second memory 140 after it is updated based on second transmission data i.e., after the second transmission data of the plurality of transmission data are transmitted and stored to the second memory 140.

In addition, the timing controller 120 may drive the data compensating part 150 using the compensation reference data stored in the second memory 140 after last transmission data of the plurality of transmission data are transmitted and stored to the second memory 140.

As described above, during an initial driving period of the display device, such as a booting time or an initialization time, the compensation reference data stored in the first memory 130 are reconstructed into a plurality of transmission data and the plurality of transmission data are sequentially transmitted and stored to the second memory 140. Thus, an image may be displayed on the display panel based on when the partial data of the plurality of transmission data are transmitted and stored.

That is, instead of waiting for all of the compensation data from each compensation block to be transmitted from the first memory 130 to the second memory 140, the data compensating part 150 may generate compensation image data based on a part of the compensation data. However, to ensure that each of the compensation blocks are at least partially compensated, the timing controller 120 may not send the compensation data from the first memory 130 to the second memory 140 block by block in an order based on the order of compensation blocks. Instead, the compensation data for the compensation blocks may be broken up so that a part of the compensation data for each block is transmittal to the second memory 140 in each transmission.

The data compensating part 150 may then generate compensation image data for each of the compensation block based on that partial compensation data that is sent in each transmission. The partial information for each compensation block may be broken up and transmitted in an order based on the significance of the bits so that the most significant bits for each block are transmitted first, and less significant bits for each block ore transmitted afterwards.

Thus a display delay may be reduced during the initial driving period of the display device. In addition, the compensating reference data stored in the second memory 140 may be applied to the data compensating part 150 in real time in accordance with the transmission of the plurality of transmission data so that a display quality of images displayed during the initial driving period may be gradually improved.

Figure 2:
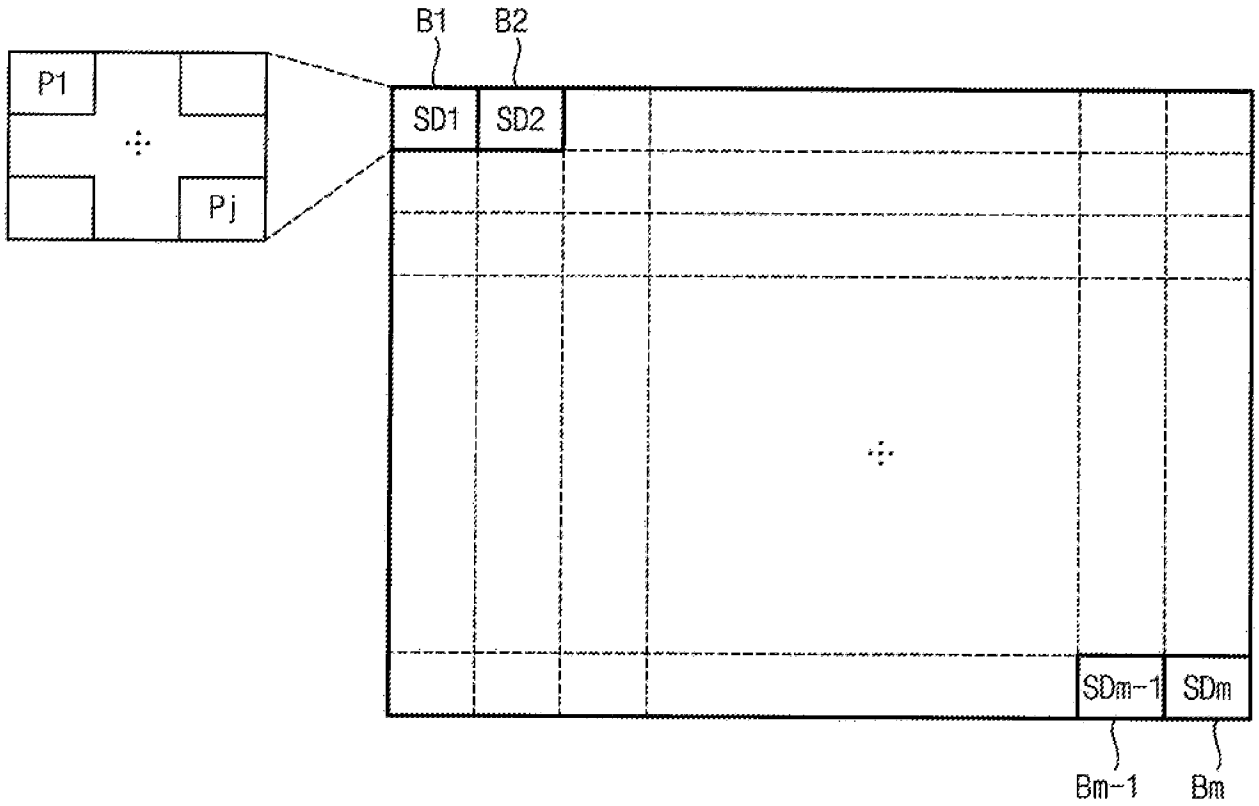
FIG. 2 is a conceptual diagram illustrating compensation reference data according to embodiments of the present disclosure.

FIG. 2 is a conceptual diagram illustrating compensation reference data according to embodiments of the present disclosure.

Referring to FIGS. 1 and 2, the first memory 130 may store a plurality of compensation reference data respectively corresponding to a plurality of compensating blocks B1, B2, . . . , Bm of the display panel 110.

The compensating block may be preset in various ways. For example, the compensating block may correspond to one pixel unit P. Alternatively, the compensating block may correspond to a plurality of pixel units P1, . . . , Pj (where 'j' is a natural number) as shown in FIG. 2.

The first memory 130 may store first to m-th compensation reference data respectively corresponding to a plurality of compensating blocks B1, B2, . . . , Bm of the display panel 110. Each of the first to m-th compensation reference data may be used as reference data for compensating image data of one or more pixel units in a corresponding compensating block.

For example, the first compensation reference data SD1 may be used as reference data for compensating image data of a plurality of pixel units P1, . . . , Pj in a first compensating block B1.

The first compensation reference data SD1 may include color reference data (e.g., red, green and blue reference data) corresponding to the color pixels of the pixel unit. Each of the color reference data may include a plurality of reference data corresponding to a plurality of sample grayscales.

For example, a plurality of red reference data may include red reference data of 16-grayscale, 32-grayscale, 64-grayscale and 128-grayscale. A plurality of green reference data may include green reference data of 16-grayscale, 32-grayscale, 64-grayscale and 128-grayscale. A plurality of blue reference data may include blue reference data of 16-grayscale, 32-grayscale, 64-grayscale and 128-grayscale.

Figure 3:
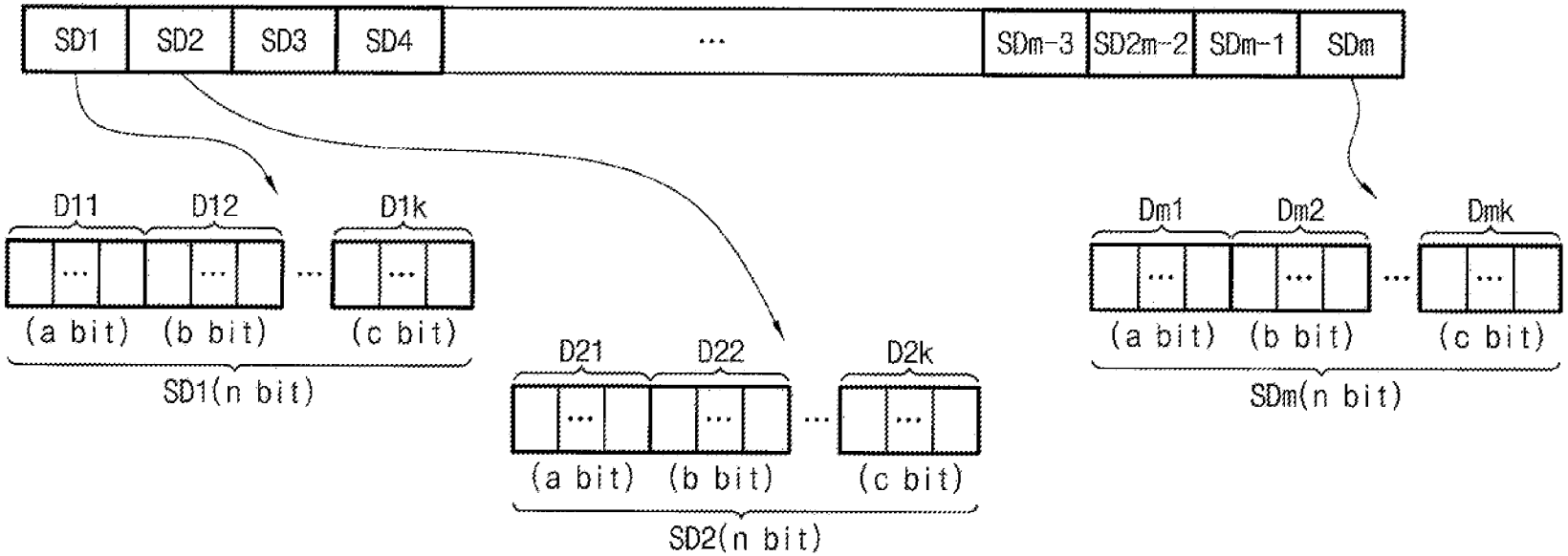
FIG. 3 is a conceptual diagram illustrating a data format of compensation reference data according to embodiments of the present disclosure.

FIG. 3 is a conceptual diagram illustrating a data format of compensation reference data according to embodiments of the present disclosure.

Referring to FIGS. 2 and 3, the first memory 130 may store the first to m-th compensation reference data SD1, SD2, . . . , SDm-1, SDm respectively corresponding to the first to m-th compensating blocks B1, B2, . . . , Bm. A size of the first to m-th compensation reference data SD1, SD2, . . . , SDm-1, SDm may be the same as (m×SP×G×n bit) according to a number (m) of the compensating block, a number (SP) of the colors in the pixel unit, a number (G) of sampling grayscales and a bit number (n) of the compensation reference data.

The timing controller 120 may be configured to divide the compensation reference data stored in the first memory 130 into a plurality of partial reference data during an initial driving period of the display device, such as a booting time or an initialization time. In some embodiments, each of the plurality of partial reference data may be preset to various bits.

The first compensation reference data SD1 may be n-bit in size (where 'n' is a natural number) and the n-bit of the first compensation reference data SD1 may be divided into first to k partial reference data D11, D12, . . . , D1*k* (where 'k' is a natural number).

First partial reference data D11 may correspond to an a-bit, second partial reference data D12 may correspond to a b-bit and k-th partial reference data D1*k* may correspond to a c-bit (where 'a', 'b' and 'c' are natural numbers). In some case, the first partial reference data D11 may correspond to the MSB (most significant bit) data of the first compensation reference data SD1.

Second compensation reference data SD2 may be an n-bit, and the n-bit of the second compensation reference data SD1 may be divided into first to k-th partial reference data D21, D22, . . . , D2*k*.

First partial reference data D21 may be an a-bit, second partial reference data D22 may be a b-bit and k-th partial reference data D2*k* may be a c-bit. The first partial reference data D21 may be MSB data of the second compensation reference data SD2.

In this manner, m-th compensation reference data SDm may be an n-bit, and the m-th n-bit of the compensation reference data SDm may be divided into first to k-th partial reference data Dm1, Dm2, . . . , Dmk.

First partial reference data Dm1 may be an a-bit, second partial reference data Dm2 D22 may be a b-bit and k-th partial reference data Dmk may be a c-bit. The first partial reference data Dm1 may be the MSB data of the m-th compensation reference data SDm.

Each of the first to k-th partial reference data may have a same bit as each other, or alternatively, a different bit from each other. Alternatively, a first partial among the first to k-th partial reference data may have a same bit and a second partial among the first to k-th partial reference data may have a different bit. Alternatively, the first partial reference data of the first to k-th partial reference data may have bits larger than bits of other partial reference data of the first to k-th partial reference data.

Figure 4:
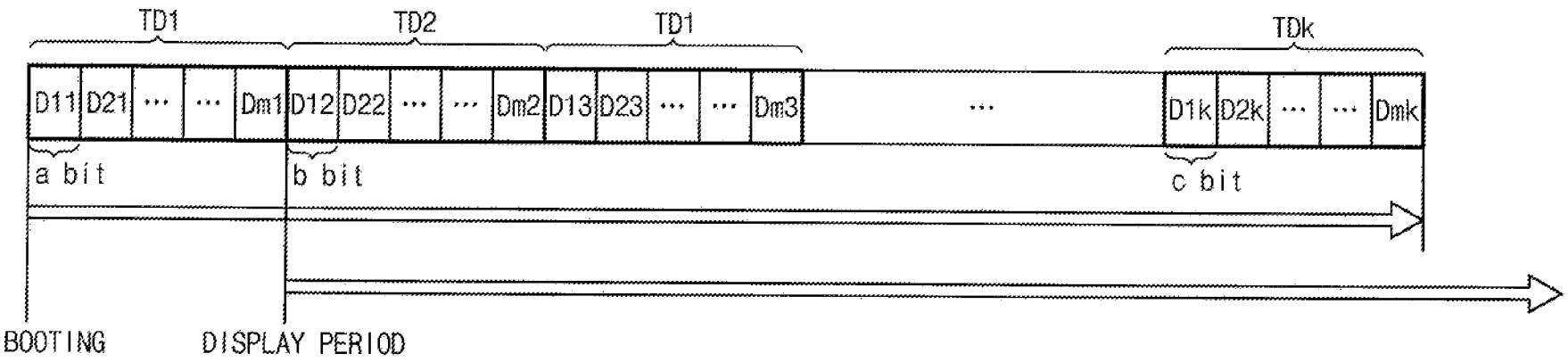
FIG. 4 is a conceptual diagram illustrating a method of transmitting compensation reference data according to embodiments of the present disclosure.

FIG. 4 is a conceptual diagram illustrating a method of transmitting compensation reference data according to embodiments of the present disclosure.

Referring to FIGS. 3 and 4, the timing controller 120 may be configured to divide the first to m-th compensation reference data SD1, SD2, . . . , SDm-1, SDm stored in the first memory 130 into the first to k-th partial reference data as shown in FIG. 3.

The timing controller 120 may also be configured to reconstruct m first partial reference data D11, D21, . . . , Dm1 with respect to the first to m-th compensation reference data SD1, SD2, . . . , SDm-1, SDm into first transmission data TD1.

The timing controller 120 may also be configured to reconstruct m second partial reference data D21, D22, . . . , Dm2 with respect to the first to m-th compensation reference data SD1, SD2, . . . , SDm-1, SDm into second transmission data TD2.

Using the methods described above, the timing controller 120 may reconstruct m k-th partial reference data D1*k*, D2*k*, . . . , Dmk with respect to the first to m-th compensation reference data SD1, SD2, . . . , SDm-1, SDm into k-th transmission data TDk.

The timing controller 120 may be configured to reconstruct the first to m-th compensation reference data SD1, SD2, . . . , SDm-1, SDm stored in the first memory 130 into the first to k-th transmission data TD1, TD2, . . . , TDk, and to sequentially transmit the first to k-th transmission data TD1, TD2, . . . , TDk to the second memory 140 in order.

Figure 5A:
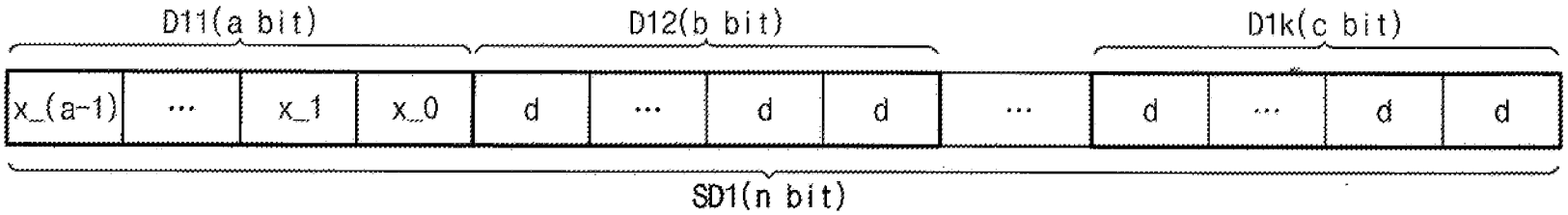
FIGS. 5A to 5C are conceptual diagrams illustrating a method of storing compensation reference data in a second memory according to a transmission order according to embodiments of the present disclosure.
Figure 5B:
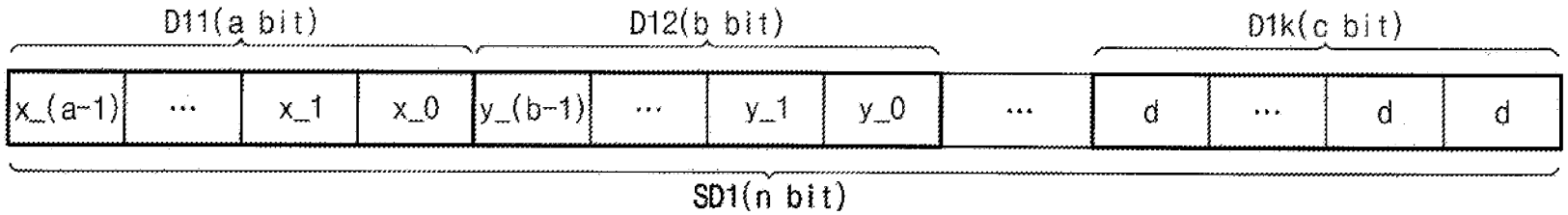
Figure 5C:
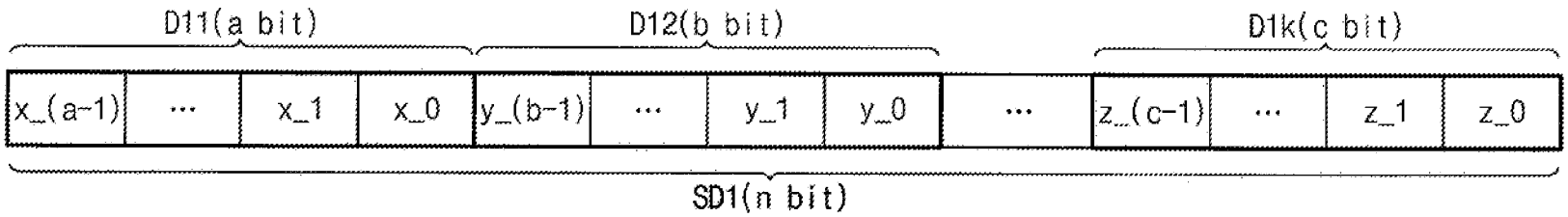

FIGS. 5A to 5C are conceptual diagrams illustrating a method of storing compensation reference data in a second memory 140 according to a transmission order according to embodiments of the present disclosure.

Referring to FIGS. 4 and 5A, the timing controller 120 may transmit and store the first transmission data TD1 with respect to the first to m-th compensation reference data SD1, SD2, . . . , SDm-1, SDm to the second memory 140.

The timing controller 120 may be configured to store the first transmission data TD1 in bit-positions in the second memory 140 corresponding to the first partial reference data D11, D21, . . . , Dm1 of the first to m-th compensation reference data SD1, SD2, . . . , SDm-1, SDm.

For example, referring to the first compensation reference data SD1, when the first transmission data TD1 are transmitted, the first partial reference data D11 among the first to k-th partial reference data D11, D12, . . . , D1*k* of the first compensation reference data SD1 are transmitted to the second memory 140 and remaining second to k-th partial reference data D12, . . . , D1*k* among the first to k-th partial reference data D11, D12, . . . , D1*k* of the first compensation reference data SD1 are not transmitted yet.

The timing controller 120 may also be configured to store a-bit data (x_(a-1), . . . , x_1, x_0) that are the first partial reference data D11 in positions of the second memory 140 corresponding to the first partial reference data D11 of the first compensation reference data SD1 using the first transmission data TD1 and store (n-a)-bit default data (d) in positions of the second memory 140 corresponding to remaining second to k-th partial reference data D12, . . . , D1*k* of the first compensation reference data SD1. For example, the default data (d) may be '0' or '1'.

Then, referring to FIGS. 4 and 5B, the timing controller 120 may transmit and store the second transmission data TD2 with respect to the first to m-th compensation reference data SD1, SD2, . . . , SDm-1, SDm to the second memory 140.

The timing controller 120 may also be configured to update the default data (d) stored as the second partial reference data D12, D22, . . . , Dm2 of the first to m-th compensation reference data SD1, SD2, . . . , SDm-1, SDm in the second memory 140 using the second transmission data TD2.

For example, referring to the first compensation reference data SD1, when the second transmission data TD2 are transmitted, the first and second partial reference data D11 and D12 among the first to k-th partial reference data D11, D12, . . . , D1*k* are transmitted to the second memory 140, and remaining third to k-th partial reference data D13, . . . , D1*k* among the first to k-th partial reference data D11, D12, . . . , D1*k* are not transmitted yet.

The timing controller 120 may also be configured to update b-bit default data corresponding to the second partial reference data D12 stored in the second memory 140 using the second transmission data TD2 as shown in FIG. 5B.

For example, the timing controller 120 may be configured to store b-bit data (y_(b-1), . . . , y_1, y_0) in b-bit positions in the second memory 140 corresponding to the second partial reference data D12 of the first compensation reference data SD1 using the second transmission data TD2 and to maintain the default data (d) stored in the second memory 140 corresponding to remaining third to k-th partial reference data D13, . . . , D1*k* of the first compensation reference data SD1.

In same methods as described above, the timing controller 120 may be configured to transmit third to (k-1)-th transmission data TD3, . . . , TDk-1 with respect to the first to m-th compensation reference data SD1, SD2, . . . , SDm-1, SDm to the second memory 140 and sequentially update the default data corresponding to the first to m-th compensation reference data SD1, SD2, . . . , SDm-1, SDm stored in the second memory 140 using the third partial reference data to the (k-1)-th partial reference data.

Finally, referring to FIGS. 4 and 5C, the timing controller 120 may be configured to transmit the k-th transmission data TDk that are a last transmission order with respect to the first to m-th compensation reference data SD1, SD2, . . . , SDm-1, SDm to the second memory 140.

The timing controller 120 may also be configured to update the default data corresponding to the k-th partial reference data D1*k*, D2*k*, . . . , Dmk of the first to m-th compensation reference data SD1, SD2, . . . , SDm-1, SDm stored in the second memory 140 using the k-th transmission data TDk.

For example, referring to tire first compensation reference data SD1, when the k-th transmission data TDk are transmitted, a transmission of the first compensation reference data SD1 is completed.

The timing controller 120 may also be configured to update c-bit default data corresponding to the k-th partial reference data D1*k* in the second memory 140 using the k-th transmission data TD2 as shown in FIG. 5C.

For example, the timing controller 120 may be configured to store c-bit data (z_(c-1), . . . , z_1, z_0) in positions of the second memory 140 corresponding to the k-th partial reference data D1*k* of the first compensation reference data SD1 using the k-th transmission data TDk.

According to an exemplary embodiment, during an initial driving period of the display device, such as a booting time or an initialization time, the first to m-th compensation reference data SD1, SD2, . . . , SDm-1, SDm stored in the first memory 130 may be reconstructed into first to k-th transmission data TD1, TD2, . . . , TDk and then the first to k-th transmission data TD1, TD2, . . . , TDk may be sequentially transmitted to the second memory 140 in order.

Therefore, as soon as the first transmission data TD1 among the first to k-th transmission data TD1, TD2, . . . , TDk are transmitted to the second memory 140, operations of the data compensating part 150 may be started. Thus, the display panel 110 may display the image from when the transmission of the first transmission data TD1 among the first to k-th transmission data TD1, TD2, . . . , TDk is completed.

According to an exemplary embodiment, during an initial driving period of the display device, such as a booting time or an initialization time, the compensation reference data stored in the first memory 130 are reconstructed using the plurality of transmission data, and the plurality of transmission data is sequentially transmitted to the second memory 140. The display panel 110 may display an image before the entire compensation data are transmitted to the second memory 140 and thus the display delay of the image may be improved during an initial driving period of the display device 100, such as a booting time or an initialization time.

Figure 6:
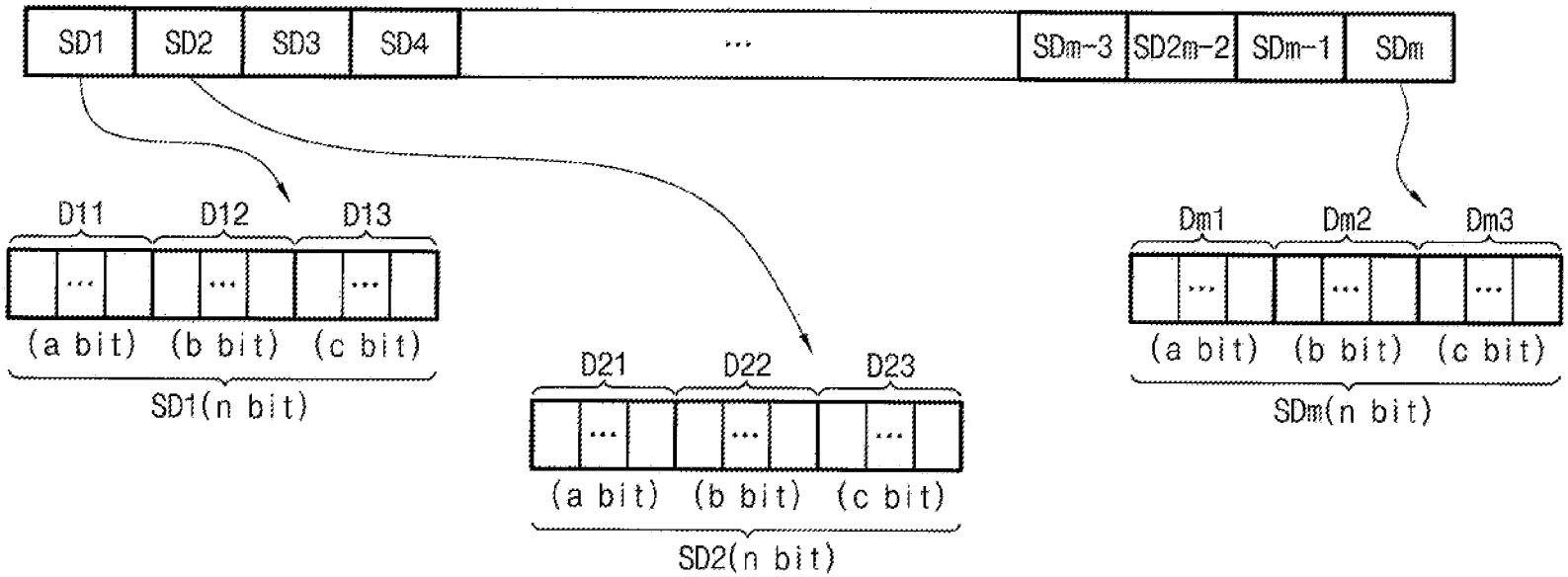
FIG. 6 is a conceptual diagram illustrating a data format of compensation reference data according to embodiments of the present disclosure.

FIG. 6 is a conceptual diagram illustrating a data format of compensation reference data according to embodiments of the present disclosure.

Referring to FIGS. 2 and 6, the timing controller 120 may be configured to divide compensation reference data stored in the first memory 130 into three partial reference data during an initial driving period of the display device, such as a booting time or an initialization time, the first memory 130.

First compensation reference data SD1 may be n-bit in size (where 'n' is a natural number), and the n-bit of the first compensation reference data SD1 may be divided into a first partial reference data D11 a-bit, a second partial reference data D12 b-bit and a third partial reference data D13 c-bit. The first partial reference data D11 may be the MSB data of the first compensation reference data SD1. Wherein, 'a', 'b', and 'c' are natural numbers and 'a' is larger than 'b' and 'c'.

Second compensation reference data SD2 may be n-bit, and the n-bit of the second compensation reference data SD2 may be divided into a first partial reference data D21 a-bit, a second partial reference data D22 b-bit and a third partial reference data D23 c-bit. The first partial reference data D21 may be the MSB data of the second compensation reference data SD2.

Third compensation reference data SD3 may be n-bit, and the n-bit of the third compensation reference data SD3 may be divided into a first partial reference data D31 a-bit, a second partial reference data D32 b-bit and a third partial reference data D33 c-bit. The first partial reference data D31 may be the MSB data of the third compensation reference data SD3.

Figure 7:
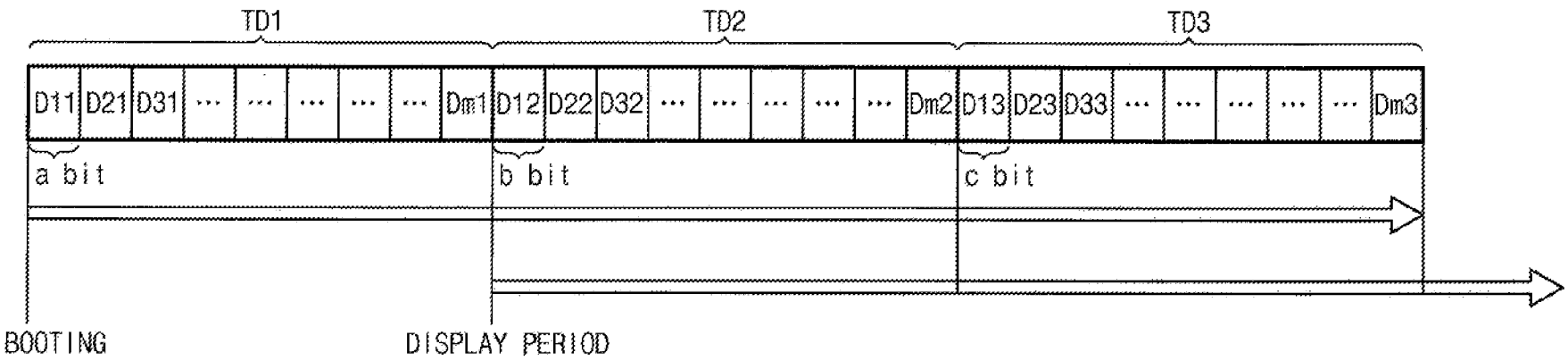
FIG. 7 is a conceptual diagram illustrating a method of transmitting compensation reference data according to embodiments of the present disclosure.

FIG. 7 is a conceptual diagram illustrating a method of transmitting compensation reference data according to embodiments of the present disclosure.

Referring to FIGS. 6 and 7, the timing controller 120 may be configured to divide the first to m-th compensation reference data SD1, SD2, . . . , SDm-1, SDm stored in the first memory 130 into the first to third partial reference data as shown in FIG. 6.

The timing controller 120 may also be configured to reconstruct the m first partial reference data D11, D21, . . . , Dm1 of the first to m-th compensation reference data SD1, SD2, . . . , SDm-1, SDm into first transmission data TD1.

The timing controller 120 may also be configured to reconstruct the m second partial reference data D21, D22, . . . , Dm2 of the first to m-th compensation reference data SD1, SD2, . . . , SDm-1, SDm into second transmission data TD2.

The timing controller 120 may also be configured to reconstruct the m third partial reference data D13, D23, . . . , Dm3 of the first to m-th compensation reference data SD1, SD2, . . . , SDm-1, SDm into third transmission data TD3.

Thus, the timing controller 120 may be configured to reconstruct the first to m-th compensation reference data SD1, SD2, . . . , SDm-1, SDm stored in the first memory 130 into the first, second and third transmission data TD1, TD2 and TD3, and to sequentially transmit first, second and third transmission data TD1, TD2 and TD3 to the second memory 140 in order.

When the first transmission data TD1 among the first, second and third transmission data TD1, TD2 and TD are transmitted to the second memory 140, the data compensating part 150 may be set to begin driving the display panel 110.

Thus, when the transmission of the first transmission data TD1 is completed, the display panel 110 may display the image.

Figure 8:
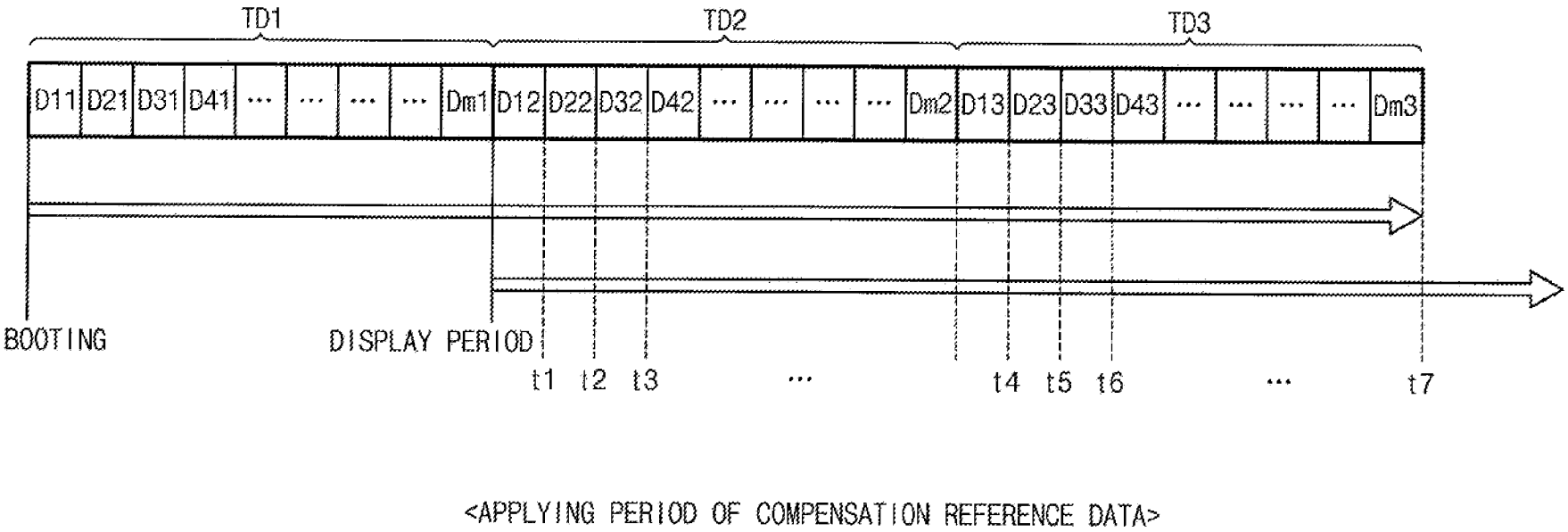
FIG. 8 is a conceptual diagram illustrating an application period of compensation reference data according to embodiments of the present disclosure.

FIG. 8 is a conceptual diagram illustrating an application period of compensation reference data according to embodiments of the present disclosure.

Referring to FIGS. 7 and 8, the application period in which the compensation reference data is applied to the data compensating part 150 may be preset according to various parameters.

According to an exemplary embodiment, the application period of the compensation reference data for compensating the image data may be preset whenever each partial reference data included in the second transmission data TD2 are transmitted and stored to the second memory 140 after the first transmission data TD1 are transmitted and stored.

Alternatively, the application period of the compensation reference data for compensating the image data may be preset whenever each partial reference data included in the first transmission data TD1 are transmitted and stored.

According to an exemplary embodiment, as shown in FIG. 8, the timing controller 120 may be configured to transmit the first transmission data TD1 to the second memory 140 with respect to the first to m-th compensation reference data SD1, SD2, . . . , SDm-1, SDm. The timing controller 120 may be configured to store the first partial reference data D11, D21, . . . , Dm1 of the first to m-th compensation reference data SD1, SD2, . . . , SDm-1, SDm in the second memory 140 using the first transmission data TD1 and to store the default data in the second memory 140 corresponding to remaining second and third partial reference data of the first to m-th compensation reference data SD1, SD2, . . . , SDm-1, SDm.

Then, the timing controller 120 may transmit the second transmission data TD2 to the second memory 140 with respect to the first to m-th compensation reference data SD1, SD2, . . . , SDm-1, SDm.

The timing controller 120 may also be configured to update the second partial reference data D12, D22, . . . , Dm2 of the first to m-th compensation reference data SD1, SD2, . . . , SDm-1, SDm stored in the second memory 140 using the second transmission data TD2. Whenever each of the second partial reference data D12, D22, . . . , Dm2 are updated, the data compensating part 150 may be configured to compensate the image data using the first to m-th compensation reference data SD1, SD2, . . . , SDm-1, SDm stored in the second memory 140 in real time.

For example, the data compensating part 150 may be configured to compensate the image data in real time using the updated first to m-th compensation reference data SD1, SD2, . . . , SDm-1, SDm starting at a first time t1 at which the second partial reference data D12 of the first compensation reference data SD1 are stored in the second memory 140.

At the first time t1, the second memory 140 may store the first compensation reference data SD1 updated the first and second partial reference data D11 and D12 and the second to m-th compensation reference data SD2, . . . , SDm-1, SDm respectively updated the first partial reference data D21, D31, . . . , Dm1.

Then, the data compensating part 150 may compensate the image data in real time using the updated first to m-th compensation reference data SD1, SD2, . . . , SDm-1, SDm starting at a second lime t2 at which the second partial reference data D22 of the second compensation reference data SD2 are stored in the second memory 140.

At the second time t2, the second memory 140 may store the first and second compensation reference data SD1 and SD2 respectively updated the first and second partial reference data (D11 and D12) and (D21 and D22) and the third to m-th compensation reference data SD3, . . . , SDm-1, SDm respectively updated the first partial reference data D31, . . . , Dm1.

Then, the data compensating part 150 may compensate the image data in real time using the updated first to m-th compensation reference data SD1, SD2, . . . , SDm-1, SDm starting at a third time t3 at which the second partial reference data D32 of the third compensation reference data SD3 are stored in the second memory 140.

At the third time t3, the second memory 140 may store the first, second and third compensation reference data SD1, SD2 and SD3 respectively updated the first and second partial reference data (D11 and D12), (D21 and D22) and (D31 and D32) and the fourth to m-th compensation reference data SD4, . . . , SDm-1, SDm respectively updated the first partial reference data D41, . . . , Dm1.

In the same method as described above, the image data may be compensated by using the first to m-th compensation reference data SD1, SD2, . . . , SDm-1, SDm updated the second partial reference data D12, D22, D32, . . . , Dm2 in real time.

Then, the timing controller 120 may transmit the third transmission data TD3 to the second memory 140 with respect to the first to m-th compensation reference data SD1, SD2, . . . , SDm-1, SDm.

When each of the third partial reference data D13, D23, . . . , Dm3 in the second memory 140 are updated by the third transmission data TD3, the data compensating part 150 may compensate the image data using the first to m-th compensation reference data SD1, SD2, . . . , SDm-1, SDm stored in the second memory 140 in real time.

For example, the data compensating part 150 may be configured to compensate the image data in real time using the updated first to m-th compensation reference data SD1, SD2, . . . , SDm-1, SDm starting at a fourth time t4 at which the third partial reference data D13 of the first compensation reference data SD1 are stored in the second memory 140.

At the fourth time t4, the second memory 140 may store the first compensation reference data SD1 updated with the first, second and third partial reference data (D11, D12 and D13) and the second to m-th compensation reference data SD2, . . . , SDm-1, SDm respectively updated with the first and second partial reference data (D21 and D22), (D31 and D32), . . . , (Dm1 and Dm2).

Then, the data compensating part 150 may compensate the image data in real time using the updated first to m-th compensation reference data SD1, SD2, . . . , SDm-1, SDm starting at a fifth time t5 at which the third partial reference data D23 of the second compensation reference data SD2 are stored in the second memory 140.

At the fifth time t5, the second memory 140 may store the first and second compensation reference data SD1 and SD2 respectively updated with the first, second and third partial reference data (D11, D12 and D13) and (D21, D22 and D23), and the third to m-th compensation reference data SD3, . . . , SDm-1, SDm respectively updated with the first and second partial reference data (D31 and D32), . . . , (Dm1 and Dm2).

Then, the data compensating part 150 may compensate the image data in real time using the updated first to m-th compensation reference data SD1, SD2, . . . , SDm-1, SDm starting at a sixth time t6 at which the third partial reference data D33 of the third compensation reference data SD3 are stored in the second memory 140.

At the sixth time t6, the second memory 140 may store the first, second and third compensation reference data SD1, SD2 and SD3 respectively updated with the first, second and third partial reference data (D11, D12 and D13), (D21, D22 and D23), and (D31, D32 and D33), and the fourth to m-th compensation reference data SD4, . . . , SDm-1, SDm respectively updated with the first and second partial reference data (D41 and D42), (Dm1 and Dm2).

In the same method as described above, the image data may be compensated by using the first to m-th compensation reference data SD1, SD2, . . . , SDm-1, SDm updated with the third partial reference data D13, D23, D33, . . . , Dm3 in real time.

Then, the data compensating part 150 may compensate the image data in real time using the updated first to m-th compensation reference data SD1, SD2, . . . , SDm-1, SDm starting at a seventh time t7 at which the third partial reference data Dm3 of the m-th compensation reference data SDm are stored in the second memory 140.

According to an exemplary embodiment, first to m-th block images displaying on first to m-th compensating blocks B1, . . . , Bm in the display panel 110 are sequentially compensated and then, the image displayed in the entire area of the display panel 110 may be compensated at the seventh time t7.

Figure 9:
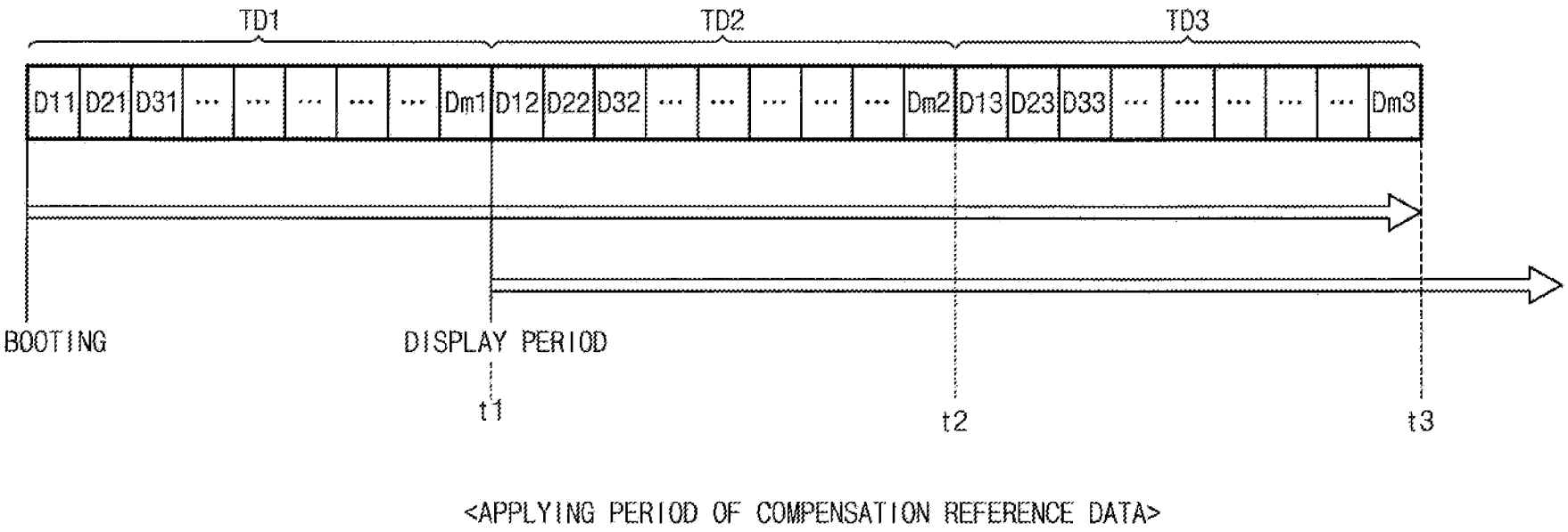
FIG. 9 is a conceptual diagram illustrating an application period of compensation reference data according to embodiments of the present disclosure.

FIG. 9 is a conceptual diagram illustrating an application period of compensation reference data according to embodiments of the present disclosure.

Referring to FIGS. 7 and 9, according to an exemplary embodiment, the application period of the compensation reference data for compensating the image data may be preset whenever each transmission data are transmitted and stored to the second memory 140 after the first transmission data TD1 are transmitted and stored.

For example, the timing controller 120 may be configured to transmit and store the first transmission data TD1 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm starting at a first time t1 at which first partial reference data D11, D21, . . . , Dm1 of the first to m-th compensation reference data SD1, SD2, . . . , SDm-1, SDm are stored in the second memory 140.

At the first time t1, the second memory 140 may store the first partial reference data D11, D21, . . . , Dm1 using the first transmission data TD1 and may store the default data corresponding to remaining second and third partial reference data.

The timing controller 120 may be configured to transmit and store the second transmission data TD2 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm starting at a second time t2 at which second partial reference data D12, D22, . . . , Dm2 of the first to m-th compensation reference data SD1, SD2, . . . , SDm-1, SDm are stored in the second memory 140.

At the second time t2, the second partial reference data D12, D22, . . . , Dm2 in the second memory 140 may be updated by the second transmission data TD2.

The timing controller 120 may be configured to transmit and store the third transmission data TD3 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm starting at a third time t3 at which third partial reference data D13, D23, . . . , Dm3 of the first to m-th compensation reference data SD1, SD2, . . . , SDm-1, SDm are stored in the second memory 140.

At the third time t3, the third partial reference data D13, D23, . . . , Dm3 in the second memory 140 may be updated by the third transmission data TD3. After the third lime t3, the second memory 140 may store complete first to m-th compensation reference data SD1, SD2, . . . , SDm-1, SDm.

According to an exemplary embodiment, when the first, second and third transmission data TD1, TD2 and TD3 are sequentially transmitted to the second memory 140, the compensation of the image displayed on the display panel 110 may be improved.

In some cases, the timing controller 120 may be configured to reconstruct first to m-th compensation reference data SD1, SD2, . . . , SDm-1, SDm stored in the first memory 130 into a plurality of transmission data for each color and to sequentially transmit the plurality of transmission data in order. That is, the compensation reference data may be divided and transmitted based on color.

For example, referring to FIGS. 8 and 9, the first compensation reference data SD1 may be divided first color reference data D11, second color reference data D12 and third color reference data D13.

First transmission data TD1 may include the first color partial reference data D11, D21, . . . , Dm1 of the first to m-th compensation reference data SD1, SD2, . . . , SDm-1, SDm. Second transmission data TD2 may include the second color partial reference data D12, D22, . . . , Dm2 of the first to m-th compensation reference data SD1, SD2, . . . , SDm-1, SDm. Third transmission data TD3 may include the third color partial reference data D13, D23, . . . , Dm3 of the first to m-th compensation reference data SD1, SD2, . . . , SDm-1, SDm.

Referring to FIG. 9, the data compensating part 150 may be configured to compensate the image data in real time using the updated first to m-th compensation reference data SD1, SD2, . . . , SDm-1, SDm starting at a first time t1 at which the first color partial reference data D11, D21, . . . , Dm1 of the first to m-th compensation reference data SD1, SD2, . . . , SDm-1, SDm are stored in the second memory 140.

The data compensating part 150 may be configured to compensate the image data in real time using the updated first to m-th compensation reference data SD1, SD2, . . . , SDm-1, SDm starting at a second time t2 at which the second color partial reference data D12, D22, . . . , Dm2 of the first to m-th compensation reference data SD1, SD2, . . . , SDm-1, SDm are stored in the second memory 140.

The data compensating part 150 may also be configured to compensate the image data in real time using the updated first to m-th compensation reference data SD1, SD2, . . . , SDm-1, SDm starting at a third time t3 at which the third color partial reference data D13, D23, . . . , Dm3 of the first to m-th compensation reference data SD1, SD2, . . . , SDm-1, SDm are stored in the second memory 140.

According to an exemplary embodiment, the image displayed on display panel may be improved in a first color quality after the first time t1, in a second color quality after the second time t2, and in a third color quality after the third time t3.

Figure 10:
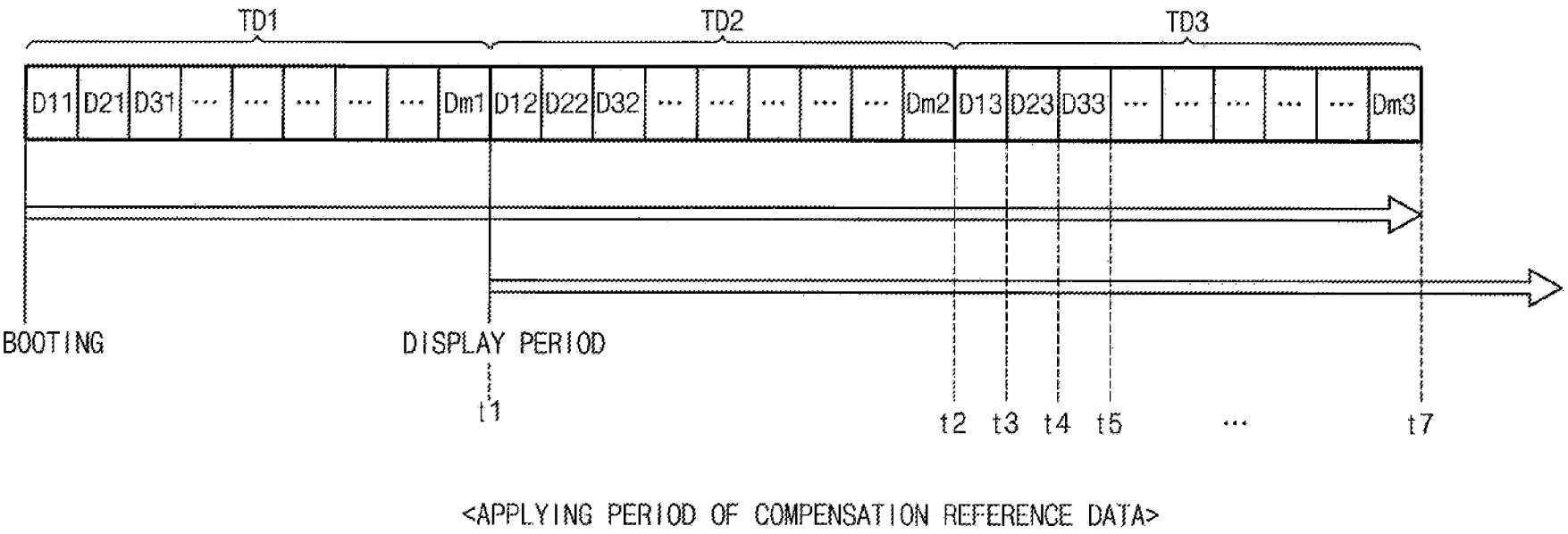
FIG. 10 is a conceptual diagram illustrating an application period of compensation reference data according to embodiments of the present disclosure.

FIG. 10 is a conceptual diagram illustrating an application period of compensation reference data according to embodiments of the present disclosure.

Referring to FIGS. 7 and 10, the application period of the compensation reference data for compensating the image data may be preset whenever at least one partial reference data included in the transmission data are transmitted and stored. In addition, the application period of the compensation reference data for compensating the image data may be preset when at least one transmission data are transmitted and stored.

For example, the timing controller 120 may be configured to transmit and store the first transmission data TD1 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm starting at a first time t1 at which first partial reference data D11, D21, . . . , Dm1 of the first to m-th compensation reference data SD1, SD2, . . . , SDm-1, SDm are stored in the second memory 140.

At the first time t1, the second memory 140 may store the first partial reference data D11, D21, . . . , Dm1 using the first transmission data TD1 and store the default data corresponding to remaining second and third partial reference data.

The timing controller 120 may be configured to transmit and store the second transmission data TD2 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm starting at a second lime t2 at which second partial reference data D12, D22, . . . , Dm2 of the first to m-th compensation reference data SD1, SD2, . . . , SDm-1, SDm are stored in the second memory 140.

At the second time t2, the second partial reference data D12, D22, . . . , Dm2 in the second memory 140 may be updated by the second transmission data TD2.

Then, the timing controller 120 may be configured to transmit and store the third transmission data TD3 to the second memory 140 with respect to the first to m-th compensation reference data SD1, SD2, . . . , SDm-1, SDm.

The data compensating part 150 may be configured to compensate the image data in real time using the updated first to m-th compensation reference data SD1, SD2, . . . , SDm-1, SDm whenever third partial reference data D13, D23, . . . , Dm3 of the first to m-th compensation reference data SD1, SD2, . . . , SDm-1, SDm are stored in the second memory 140.

The data compensating part 150 may be configured to compensate the image data in real time using the updated first to m-th compensation reference data SD1, SD2, . . . , SDm-1, SDm starting at a third time t3 at which the third partial reference data D13 of the first compensation reference data SD1 are stored in the second memory 140.

Then, the data compensating part 150 may compensate the image data in real time using the updated first to m-th compensation reference data SD1, SD2, . . . , SDm-1, SDm starting at a fourth time 14 at which the third partial reference data D23 of the second compensation reference data SD2 are stored in the second memory 140.

Then, the data compensating part 150 may compensate the image data in real time using the updated first to m-th compensation reference data SD1, SD2, . . . , SDm-1, SDm starting at a fifth time t5 at which the third partial reference data D33 of the third compensation reference data SD3 are stored in the second memory 140.

Then, the data compensating part 150 may compensate the image data in real time using the updated first to m-th compensation reference data SD1, SD2, . . . , SDm-1, SDm starting at a seventh time t7 at which the third partial reference data Dm3 of the m-th compensation reference data SDm are stored in the second memory 140.

According to an exemplary embodiment, the image quality displayed on display panel 110 may be generally improved, and the block image quality corresponding to compensating blocks B1, . . . , Bm of the display panel 110 may be sequentially improved.

According to an exemplary embodiment, during an initial driving period of the display device, such as a booting time or an initialization time, the compensation reference data stored in the first memory 130 are reconstructed using the plurality of transmission data, and the plurality of transmission data is sequentially transmitted to the second memory 140. The display panel 110 may display an image before all of the compensation data is transmitted to the second memory 140 and thus the display delay of the image may be improved during the initial driving period of the display device.

The present inventive concept may be applied to a display device and/or an electronic device that includes a display device. For example, the present inventive concept may be applied to a computer monitor, a laptop, a digital camera, a cellular phone, a smart phone, a smart pad, a television, a personal digital assistant (PDA), a portable multimedia player (PMP), an MP3 player, a navigation system, a game console, a video phone, etc.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display device comprising:

a display panel comprising a plurality of pixel units;

a first memory configured to store compensation reference data; a second memory configured to receive and store a plurality of transmission data;

wherein compensating image data is based on at least partial data of the plurality of transmission data stored in the second memory; and a timing controller configured to reconstruct the compensation reference data into the plurality of transmission data, to sequentially transmit the plurality of transmission data to the second memory, and to cause an image to be displayed on the display panel when the partial data of the plurality of transmission data are transmitted and stored to the second memory during an initial driving period, wherein the compensation reference data comprise m compensation reference data corresponding to m compensating blocks where m is a natural number greater than one, the display panel being divided into the m compensating blocks, each of the m compensating blocks includes at least one pixel unit of the plurality of pixel units, and each pixel unit includes a plurality of color pixels;

wherein the timing controller is configured to divide the compensation reference data into k partial reference data where k is a natural number, and to reconstruct the k partial reference data of the m compensation reference data into k transmission data, wherein each of the k transmission data comprises partial reference data for each of the m compensating blocks.

2. The display device of claim 1, wherein the timing controller is configured to divide the compensation reference data into the k partial reference data by color.

3. The display device of claim 1, wherein first partial reference data of the k partial reference data comprise most significant bit (MSB) data.

4. The display device of claim 1, wherein the timing controller is configured to cause the image to be displayed on the display panel when first transmission data of the k transmission data are transmitted and stored to the second memory.

5. The display device of claim 1, wherein the timing controller is configured to store transmission data transmitted from the first memory in a first position in the second memory and to store default data in a second position in the second memory corresponding to transmission data not transmitted from the first memory.

6. The display device of claim 1, wherein compensated image data uses updated compensation reference data, wherein the updated compensation reference data is updated in the second memory whenever each transmission data are transmitted and stored to the second memory.

7. The display device of claim 1, wherein compensated image data uses updated compensation reference data, wherein the updated compensation reference data is updated in the second memory whenever each partial reference data in the transmission data are transmitted and stored to the second memory.

8. The display device of claim 1, wherein compensated image data uses updated compensation reference data, wherein the updated compensation reference data is updated in the second memory whenever at least one transmission data are transmitted and stored to the second memory, and at least one partial reference data in transmission data are transmitted and stored to the second memory.

9. A method of driving a display device which comprises a display panel including a plurality of pixel units, the method comprising:

reconstructing compensation reference data stored in a first memory into a plurality of transmission data during an initial driving period, wherein each of the plurality of transmission data comprises partial reference data for each of one or more compensation blocks of the display panel;

sequentially transmitting the plurality of transmission data to second memory; and displaying an image on the display panel when a first transmission data of the plurality of transmission data is transmitted and stored to the second memory, wherein the compensation reference data comprise m compensation reference data corresponding to m compensating blocks where m is a natural number greater than one, the display panel being divided into the m compensating blocks, each of the m compensating blocks including at least one pixel unit of the plurality of pixel units, and each pixel unit including a plurality of color pixels, further comprising:

dividing the compensation reference data into k partial reference data where k is a natural number; and reconstructing the k partial reference data of the m compensation reference data into k transmission data, wherein each of the k transmission data comprises partial reference data for each of the m compensating blocks.

10. The method of claim 9, further comprising:

dividing the compensation reference data into the k partial reference data by color.

11. The method of claim 9, wherein first partial reference data of the k partial reference data are most significant bit (MSB) data.

12. The method of claim 9, further comprising:

compensating the image on the display panel using the first transmission data when second transmission data of the plurality of transmission data are transmitted and stored to the second memory.

13. The method of claim 9, further comprising:

storing transmission data transmitted from the first memory in a first position in the second memory; and storing default data in a second position in the second memory corresponding to transmission data not transmitted from the first memory.

14. The method of claim 9, further comprising: compensating image data using updated compensation reference data, wherein the updated compensation reference data is updated in the second memory whenever each transmission data are transmitted and stored to the second memory.

15. The method of claim 9, further comprising: compensating image data using updated compensation reference data, wherein the updated compensation reference data is updated in the second memory whenever each partial reference data in transmission data are transmitted and stored to the second memory.

16. The method of claim 9, further comprising: compensating image data using updated compensation reference data, wherein the updated compensation reference data is updated in the second memory whenever each transmission data are transmitted and stored to the second memory; and wherein the updated compensation reference data is updated in the second memory whenever each partial reference data in transmission data are transmitted and stored to the second memory.

* * * * *